United States Patent [19]

Harandi et al.

[11] Patent Number: 4,950,387

[45] Date of Patent: Aug. 21, 1990

[54] UPGRADING OF CRACKING GASOLINE

[75] Inventors: Mohsen N. Harandi, Lawrenceville; Hartley Owen, Belle Mead; Francis P. Ragonese, Cherry Hill, all of N.J.; Sergei Yurchak, Media, Pa.

[73] Assignee: Mobil Oil Corp., New York, N.Y.

[21] Appl. No.: 260,635

[22] Filed: Oct. 21, 1988

[51] Int. Cl.[5] ..... C10G 57/00; C10G 63/04

[52] U.S. Cl. ..... 208/49; 208/70; 208/92; 208/93; 208/94; 585/322; 585/330

[58] Field of Search ..... 208/67, 69, 70, 49, 208/93, 94; 585/322, 412, 424, 330, 407, 410

[56] References Cited

U.S. PATENT DOCUMENTS

| | | | |
|---|---|---|---|
| 3,759,821 | 9/1973 | Brennan et al. | 208/93 |
| 3,760,024 | 9/1973 | Cattanach | 260/673 |
| 3,845,150 | 10/1974 | Yan et al. | 260/673.5 |
| 3,907,663 | 9/1975 | Owen | 208/70 |
| 3,950,242 | 4/1976 | Garwood et al. | 208/70 |
| 3,960,978 | 6/1976 | Givens et al. | 260/683.15 R |
| 4,021,502 | 5/1977 | Plank et al. | 260/683.15 R |
| 4,090,949 | 5/1978 | Owen et al. | 208/78 |
| 4,150,062 | 4/1979 | Garwood et al. | 260/673 |
| 4,211,640 | 7/1980 | Garwood et al. | 208/255 |
| 4,227,992 | 10/1980 | Garwood et al. | 208/46 |
| 4,324,940 | 4/1982 | Dessan | 585/407 |
| 4,433,185 | 2/1984 | Tabak | 585/312 |
| 4,456,779 | 6/1984 | Owen et al. | 585/415 |
| 4,456,781 | 6/1984 | Marsh et al. | 585/533 |
| 4,483,760 | 11/1984 | Tabak et al. | 585/322 |
| 4,497,968 | 2/1985 | Wright et al. | 585/304 |
| 4,511,747 | 4/1985 | Wright et al. | 585/424 |
| 4,753,720 | 6/1988 | Morrison | 208/70 |
| 4,777,316 | 10/1988 | Harandi et al. | 585/533 |
| 4,784,745 | 11/1988 | Nace | 208/70 |
| 4,788,364 | 11/1988 | Harandi | 585/322 |
| 4,808,295 | 2/1989 | Nemet-Mavrodin | 585/412 |
| 4,822,477 | 4/1989 | Avidan et al. | 208/70 |

*Primary Examiner*—Anthony McFarlane

*Attorney, Agent, or Firm*—Alexander J. McKillop; Charles J. Speciale; Robert B. Furr, Jr.

[57] ABSTRACT

A process is disclosed for increasing the octane number of an FCC unit gasoline pool by upgrading selected gasoline boiling-range streams. FCC gasoline is mixed with the feed to a light olefin upgrading reactor. Upgraded gasoline is then fractionated in an existing FCC gas plant.

11 Claims, 3 Drawing Sheets

UPGRADING OF CRACKING GASOLINE

CROSS-REFERENCE TO RELATED APPLICATIONS

This application is related to U.S. application Ser. No. 122,477, filed Nov. 5, 1987, which is a continuation of application Ser. No. 54,062, filed May 18, 1987, which is a continuation-in-part of application Ser. No. 796,045, filed Nov. 7, 1985.

This application is also related to U.S. application Ser. No. 40,707, filed Apr. 16, 1987, which is a continuation of application Ser. No. 769,791, filed Aug. 26, 1985, which is a continuation of application Ser. No. 701,312, filed Feb. 13, 1985.

FIELD OF THE INVENTION

This invention relates to a catalytic technique for upgrading low-octane gasoline produced by a fluidized catalytic cracking (FCC) unit. In particular, the present invention provides a process for producing upgraded gasoline by integrating a light olefin upgrading reaction zone with a catalytic cracking process unit product fractionation section.

BACKGROUND OF THE INVENTION

Developments in zeolite catalysis and hydrocarbon conversion processes have created interest in utilizing olefinic feedstocks for producing $C_5+$ gasoline, diesel fuel, etc.

In addition to basic chemical reactions promoted by medium-pore zeolite catalysts, a number of discoveries have contributed to the development of new industrial processes. These are safe, environmentally acceptable processes for utilizing feedstocks that contain olefins. Conversion of $C_2$–$C_4$ alkenes and alkanes to produce aromatics-rich liquid hydrocarbon products were found by Cattanach (U.S. Pat. No. 4,760,024) and Yan et al. (U.S. Pat. No. 3,845,150) to be effective processes using zeolite catalyst having the structure of ZSM-5. The '150 patent to Yan et al. teaches a heat-balanced process for producing aromatic gasoline. In U.S. Pat. Nos. 3,960,978 and 4,021,502, Plank, Rosinski and Givens disclose conversion of $C_2$–$C_5$ olefins, alone or in admixture with paraffinic components, into higher hydrocarbons over crystalline zeolites having controlled acidity. Garwood et al. have also contributed to the understanding of catalytic olefin upgrading techniques and improved processes as in U.S. Pat. Nos. 4,150,062, 4,211,640 and 4,227,992. The above-identified disclosures are incorporated herein by reference.

U.S. Pat. No. 3,759,821 to Brennan et al. teaches a process for the catalytic upgrading of a cracked gasoline which involves fractionating a catalytically cracked gasoline into a $C_6$-overhead and a $C_7+$ bottom fraction and contacting the $C_7+$ bottom fraction with a catalyst having the structure of ZSM-5.

Conversion of olefins, especially alpha-monoalkenes such as propene and butenes, over HZSM-5 is effective at moderately elevated temperatures and pressures. The conversion products are sought as liquid fuels, especially the $C_5+$ aliphatic and aromatic hydrocarbons. Product distribution for liqud hydrocarbons can be varied by controlling process conditions, such as temperature, pressure and space velocity. Aromatic gasoline ($C_5$–$C_{10}$) is readily formed at elevated temperature (e.g. about 425° to 650° C.) and moderate pressure from ambient to about 5500 kPa, preferably about 200 to 2900 kPa. Olefinic gasoline can also be produced and may be recovered as a product or fed to a low severity, high pressure reactor system for further conversion to heavier distillate range products or otherwise utilized. Operating details for typical "MOGD" oligomerization units are disclosed in U.S. Pat. Nos. 4,456,779; 4,497,968 (Owen et al.) and 4,433,185 (Tabak), incorporated herein by reference.

In MOGD and MOGDL, olefins are catalytically converted to heavier hydrocarbons by catalytic oligomerization using an acid crystalline zeolite, such as a zeolite catalyst having the structure of ZSM-5. Process conditions can be varied to favor the formation of either gasoline, distillate or lube range products. U.S. Pat. Nos. 3,960,978 and 4,021,502 to Plank et al. disclose the conversion of $C_2$–$C_5$ olefins alone or in combination with paraffinic components, into higher hydrocarbons over a crystalline zeolite catalyst. U.S. Pat. Nos. 4,150,062; 4,211,640 and 4,227,992 to Garwood et al. have contributed improved processing techniques to the MOGD system. U.S. Pat. No. 4,456,781 to Marsh et al. has also disclosed improved processing techniques for the MOGD system. The conversion of olefins in an MOGDL system may occur in a gasoline mode and/or a distillate/lube mode. In the gasoline mode, the olefins are typically oligomerized at temperatures ranging from 200° C. to 430° C. (400° F. to 800° F.) and pressures ranging from 70 kPa to 6900 kPa (10 to 1000 psia).

U.S. Pat. No. 4,090,949 to Owen and Venuto teaches a process for upgrading olefinic gasoline by recycling FCC gasoline to a second FCC riser together with a stream of light $C_2$–$C_5$ olefins which serve as hydrogen contributors. The processing scheme disclosed in the '949 patent recycles gasoline through the FCC gas plant thereby increasing both capital and operating costs associated with the gas plant. Further, recycling gasoline to the riser of a catalytic cracking unit exposes the gasoline to severe temperature conditions which promote cracking and tend to decrease gasoline yield. Thus it can be seen that it would be highly desirable to provide a process for upgrading highly olefinic gasoline produced in a catalytics cracking process while at the same time utilizing the existing catalytic cracking unit gas plant to separate the upgraded gasoline product.

SUMMARY OF THE INVENTION

The present invention provides a process for upgrading olefinic gasoline produced in a catalytic cracking unit. The invention integrates gasoline upgrading with the catalytic cracking unit gas plant yielding significant cost savings over previous designs which either recycled upgraded gasoline through an expanded gas plant or employed a separate dedicated fractionation section. By integrating the gasoline upgrading process into a one-through fractionation section, existing catalytic cracking units may be modernized to improve gasoline quality without expanding the existing catalytic cracking unit gas plants. Moreover, by upgrading an intermediate gasoline stream in a catalytic reaction zone separate from the catalytic cracking unit reactor riser, reaction temperature may be controlled to minimize undesirable cracking thereby maximizing yield.

The process of the present invention is an integrated catalytic cracking and gasoline upgrading process comprising the steps of withdrawing a product stream from the reactor of a catalytic cracking process unit, charging the product stream to a primary fractionation zone, withdrawing an intermediate gasoline stream comprising olefinic gasoline and $C_4$- aliphatics from the primary fractionation zone, contacting a first portion of the intermediate gasoline stream and a $C_2$–$C_5$ olefinic stream with a catalyst in a catalytic reaction zone outside the catalytic cracking process unit reactor riser under conversion conditions to form an upgraded gasoline stream, and charging a second portion of said intermediate gasoline stream together with said upgraded gasoline stream to a product fractionation section.

DETAILED DESCRIPTION

Figure 1:
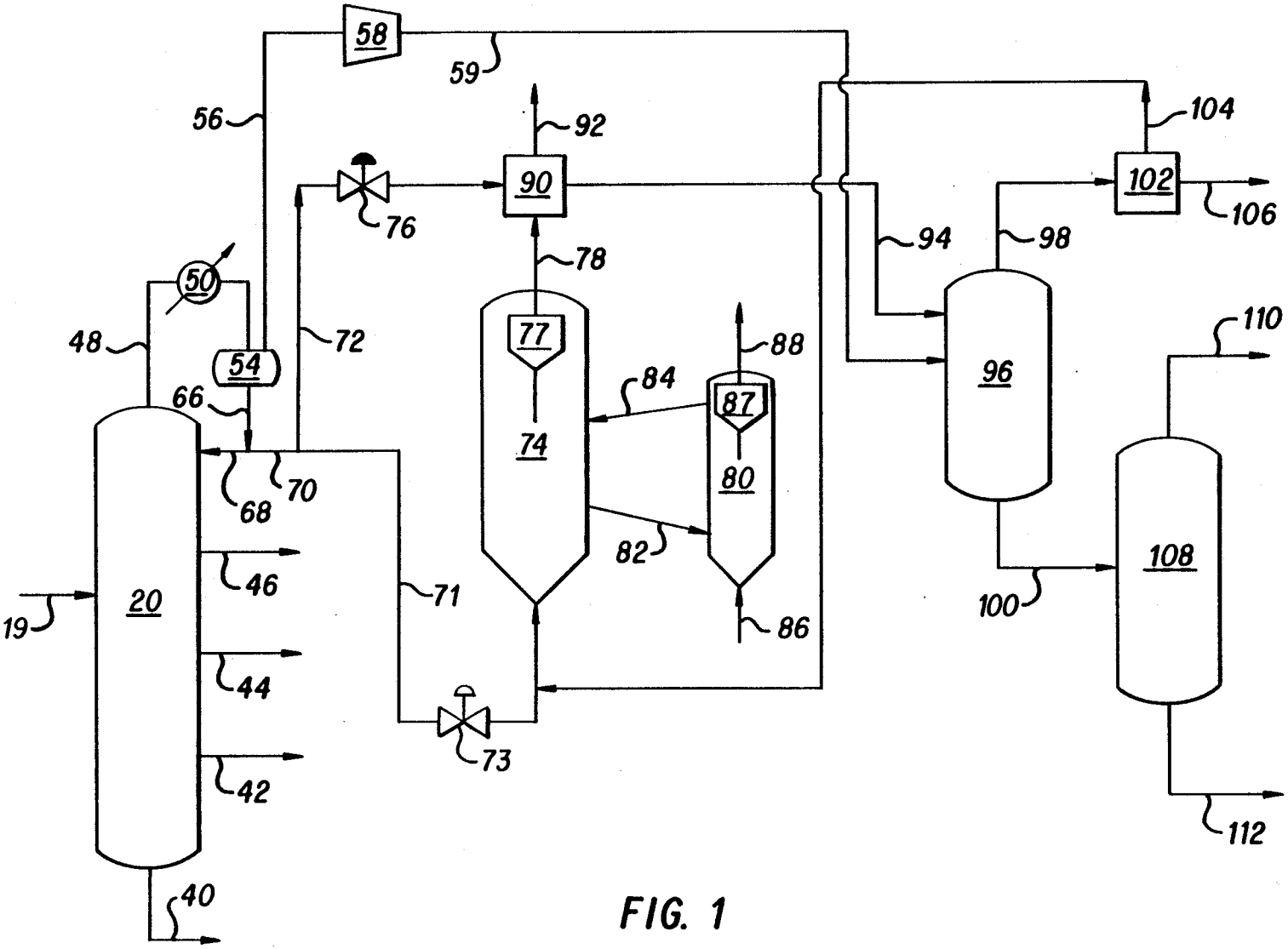
FIG. 1 is a simplified schematic diagram showing a first embodiment of the present inventive process for upgrading a mixture of FCC mid-boiling range gasoline and light olefins.

The present invention upgrades part or all of the gasoline boiling range effluent from an FCC unit. A light olefinic hydrocarbon stream is blended with the gasoline feed to minimize heat input to the reaction zone.

This light olefinic stream is typically drawn from the deethanizer overhead of an FCC unit unsaturated gas plant. The olefin content can be increased by adding all or a portion of the olefin-rich $C_3$ and $C_4$ products from the catalytic cracking unit product fractionation section. Alternatively, the light olefin feed may be drawn exclusively from the catalytic cracking unit $C_3$ and $C_4$ product streams. The relative flow rates of the two streams may vary based on availability, but the preferred range of charge rates ranges from about 1 mole of $C_4$- olefin per mole of FCC gasoline feed to about 10 moles of $C_4$- olefin per mole of FCC gasoline feed. The gasoline feedstream useful in the present invention is a $C_5$ to 221° C. (430° F.) cut. Characteristics of a typical gasoline feedstream useful in the present invention are sown in Table 1. A distillation for a typical FCC gasoline together with research octane numbers is shown in Table 2. Process conditions for the aromatization reaction zone are shown in Table 3.

TABLE 1

| FCC Gasoline Typical Composition | |
|---|---|
| Aromatics | 16–21 vol. % |
| Olefins | 56–61 vol. % |
| Paraffins | 23–24 vol. % |

TABLE 2

FCC Gasoline Typical Distillation and Octane Number by Cuts

| | Cut Point[1] | | | |
|---|---|---|---|---|
| Vol. % | TBP °C. | D86 °C. | Rel. Density | Clear RON[2] |
| 0–20 | 38 | 66 | — | 96.7 |
| 20–40 | 59 | 92 | 0.6944 | 94.2 |
| 40–60 | 94 | 125 | 0.7489 | 92.2 |
| 60–80 | 127 | 165 | 0.8010 | 92.2 |

TABLE 2-continued

FCC Gasoline Typical Distillation and Octane Number by Cuts

| | Cut Point[1] | | | |
|---|---|---|---|---|
| Vol. % | TBP °C. | D86 °C. | Rel. Density | Clear RON[2] |
| 80–100 | — | 208 | 0.8500 | 93.8 |

[1]Expressed in True Boiling Point as well as ASTM D86 Boiling Point (Actual Distillation Boiling Point corrected to 1 atmospheric pressure).
[2]Research Octane Number

TABLE 3

Aromatization Reaction Zone Conditions

| | | |
|---|---|---|
| WHSV based on $C_4$- light olefins) | Broad range | 0.1–100 $hr^{-1}$ |
| | Preferred range | 0.5–1 $hr^{-1}$ |
| Pressure | Broad range | 101–4238 kPa (0–600 psig) |
| | Preferred range | 274–1136 kPa (25–150 psig) |
| Temperature | Broad range | 149–482° C. (300–900° F.) |
| | Preferred range | 260–399° C. (500–750° F.) |

Process Flow

Operating details of FCC units in general and FCC regenerators in particular can be found in: U.S. Pat. Nos. 2,383,636 to Wirth; 2,689,210 to Leffer; 3,338,821 to Moyer et al; 3,812,029 to Snyder, Jr.; 4,093,537 to Gross et al; 4,118,338 to Gross et al and 4,218,306 to Gross et al., as well as in Venuto et al. *Fluid Catalytic Cracking with Zeolite Catalysts*, Marcel Dekker, Inc., (1979). The entire contents of all the above patents and publications are incorporated herein by reference.

First Embodiment

In a first embodiment, light olefinic FCC gasoline is mixed with a $C_3$- olefinic stream and upgraded. Referring to FIG. 1, the product stream from an FCC unit riser reactor is charged through line 19 to fractionation zone 20 where it is separated into streams including clarified slurry oil flowing through line 40, heavy cycle oil flowing through line 42, light cycle oil flowing through line 44, heavy naphtha flowing through line 46, and olefinic gasoline and lighter components flowing through line 48. The olefinic gasoline mixture flows through line 48 to overhead cooler 50 where it is cooled to about 38° C. (100° F.) and is then charged through line 49 to overhead drum 54 where light hydrocarbons, typically $C_2$ and lighter hydrocarbons, are flashed off and leave overhead accumulator 54 through line 56. The light hydrocarbons, commonly referred to as wet gas, are charged through line 56 to wet gas compressor 58 and then to an upper tray of deethanizer fractionator 96 through line 59. The wet gas feed tray is preferably located below the gasoline feed tray.

Liquid product comprising olefinic gasoline and lighter aliphatic hydrocarbon flows from overhead accumulator 54 through line 66 and is split between lines 68 and 70. A portion of the liquid product is refluxed to an upper tray of fractionation section 20 while the remaining volume of olefinic gasoline and lighter aliphatic hydrocarbons flows through line 70 into lines 71 and 72. Lines 71 and 72 are equipped with flow control valves 73 and 76, respectively. This valving arrangement enables the refiner to adjust the relative flow rates of olefinic gasoline flowing through line 71 to be upgraded and olefinic gasoline bypassing the upgrading reaction through line 72.

The olefinic gasoline stream to be upgraded flows through line 71 and is mixed with an aliphatic stream rich in $C_3$- olefins. Preferably, the light olefinic stream is a purified deethanizer fractionator overhead stream as illustrated. The purified deethanizer fractionator overhead stream flows through line 104 into line 71. The combined stream of olefinic gasoline and $C_3$- olefins is charged to the bottom of fluidized bed reactor 74. Charge rate to fluidized bed reactor 74 is maintained at a rate such that the finely divided catalyst in fluidized bed reactor 74 is maintained in a state of a sub-transport fluidization, preferably turbulent sub-transport fluidization. Entrained catalyst is separated from the reaction products in cyclone separator 77 and is withdrawn from fluidized bed reactor 74 through line 78. For details of the operation of a turbulent fluidized catalyst bed reactor, see U.S. Pat. No. 4,746,762 to Avidan et al., incorporated herein by reference.

During the course of the gasoline upgrading reaction, the finely divided fluidized catalyst becomes deactivated as a layer of coke is deposited on the surface of the catalyst. This layer of coke blocks access to the catalyst pores thus inhibiting catalytic activity. A stream of deactivated catalyst is continuously withdrawn from fluidized bed reactor 74 and charged to continuous regenerator 80 through line 82. An oxygen containing gas, for example, air, is charged to the bottom of continuous regenerator 80 through line 86 at a rate sufficient to suspend the deactivated catalyst in a state of sub-transport fluidization. Oxidated regeneration of the catalyst is highly exothermic with regeneration temperatures typically in the range of 649° C. (1200° F.). Coke deposited on the catalyst reacts with oxygen to form flue gas comprising unreacted regeneration gas, water and carbon dioxide. Flue gas is separated from the entrained catalyst in cyclone separator 87, positioned near the top of continuous regenerator 80, and is withdrawn from the regenerator through line 88. Regenerated catalyst is returned to fluidized-bed reactor 74 through line 84. The flow rate and composition of the feedstreams to fluidized bed reactor 74 are preferably controlled such that reactor 74 operates in a heat-balanced mode. However, feed temperature and composition, as well as other factors including catalyst circulation rate, may require heat input to, or withdrawal from the fluidized bed reactor 74 to maintain reaction temperature within the ranges listed above. If such heat transfer is required, a heat exchanger (not shown) may be positioned in the lower section of fluidized bed reactor 74 to heat or cool the reaction zone.

The reaction product stream comprising upgraded gasoline together with higher aliphatic components is charged through line 78 to a fractionator 90 together with olefinic gasoline flowing through line 72. Light $C_3$- aliphatic gas is withdrawn from fractionator 90 through line 92 and may be charged to a sponge absorber (not shown) which uses a heavy naphtha or light cycle oil stream to absorb $C_4$+ components from the predominately $C_3$- light gas stream.

Gasoline is withdrawn from fractionator 90 through line 94 and charged to an upper tray of deethanizer fractionator 96. Compressed wet gas from wet gas compressor 58 flows through line 59 and is charged to a gasoline feed tray in the upper section of deethanizer fractionator 96. Compressed wet gas comprising $C_3$- aliphatics is charged from wet gas compressor 59 through line 59 and enters deethanizer fractionator 96 at an upper tray located below the gasoline feed tray as described above. The deethanizer fractionator overhead product is withdrawn through line 98 and charged to amine treater 102 to remove hydrogen sulfide from the light $C_3$- aliphatic gas. Hydrogen sulfide leaves amine feeder 102 through line 106 and may be charged to a sulfide recovery unit (not shown). The purified light aliphatic gas stream is then withdrawn from amine treater 102 through line 104 and charged to line 71 as described above.

The deethanizer bottoms product comprising deethanized upgraded gasoline is charged through line 100 to debutanizer 108. An olefin-rich $C_3$–$C_4$ stream flows overhead through line 110 and may be advantageously upgraded in an alkylation unit (not shown). Debutanized upgraded gasoline product flows through line 112 to gasoline treatment blending and storage facilities (not shown).

SECOND EMBODIMENT

Figure 2:
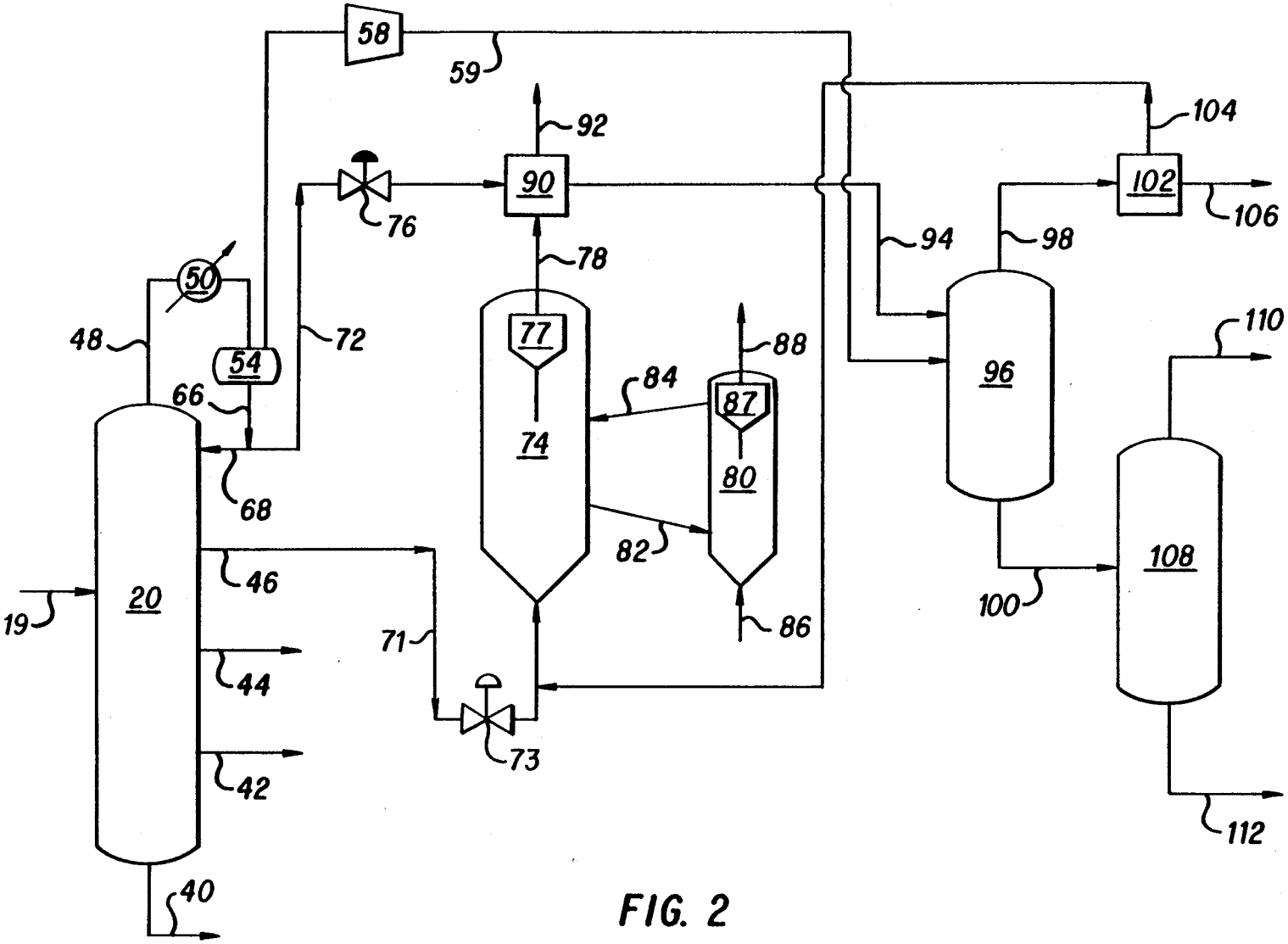
FIG. 2 is a simplified schematic diagram showing a second embodiment of the present inventive process for upgrading a mixture of FCC heavy gasoline and light olefins.

In a second embodiment of the present invention, a heavy naphtha stream is mixed with a light olefinic stream and upgraded in a fluidized-bed reactor. Referring now to FIG. 2, it can be seen that the second embodiment is identical to the first embodiment with the exception of the following changes in flow scheme.

In the first embodiment, the flow of an olefinic gasoline stream taken overhead from a fractionation zone 20 is split between a first stream which is catalytically upgraded and a second stream which bypasses the catalytic reactor. In contrast, the second embodiment of the invention upgrades the heavy naphtha stream flowing through line 46 from fractionation zone 20.

Referring now to FIG. 2, the operation of fractionation zone 20 is essentially identical to that described in the first embodiment. A liquid stream comprising olefinic gasoline and lighter components is withdrawn from overhead accumulator 54 through line 66 and split between line 68 which refluxes olefinic gasoline and lighter components to an upper tray of fractionation zone 20, and line 72, equipped with flow control valve 76, which charges the olefinic gasoline stream to fractionator 90 as described above in the first embodiment.

The second embodiment differs from the first embodiment in that heavy naphtha is withdrawn from fractionation zone 20 through line 46, enters line 71 which is equipped with flow control valve 73, is combined with a light $C_3$-olefinic stream flowing through line 104, and charged to the bottom of fludized bed reactor 74. The remaining processing steps of the second embodiment are identical to those of the first embodiment.

THIRD EMBODIMENT

In a third embodiment of the present invention, a "heart cut" of heavy naphtha is upgraded in a fluidized bed reactor. Operation of the third embodiment is identical to that of the second embodiment with the exception that a heavy naphtha splitter is added to the flow scheme.

Figure 3:
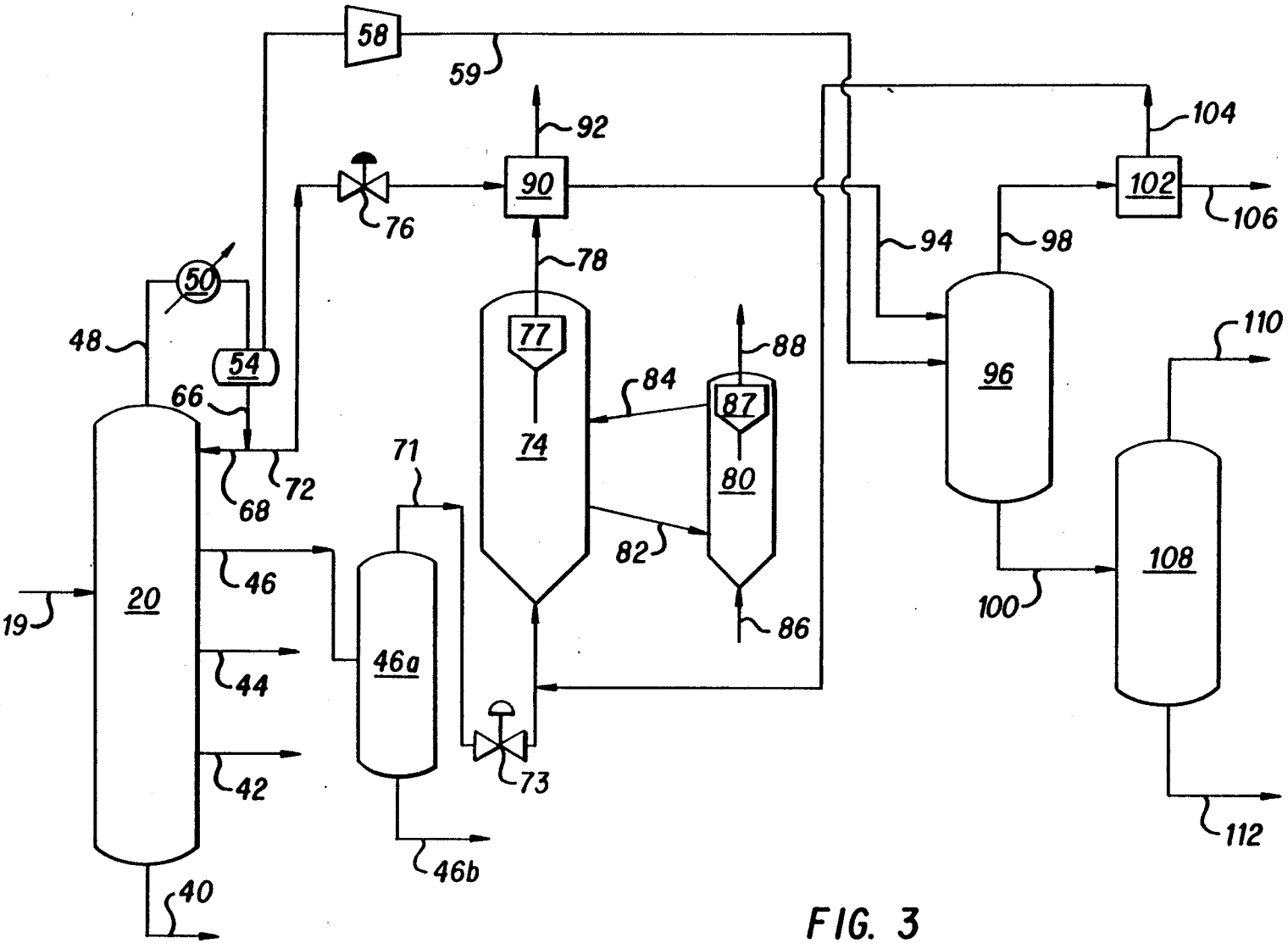
FIG. 3 is a simplified schematic diagram showing a third embodiment of the present inventive process for upgrading a predominately $C_7$–$C_8$ heart cut of FCC gasoline and light olefins.

Referring now to FIG. 3, heavy naphtha is withdrawn from fractionation zone through line 46 and charged to heavy naphtha splitter **46*a*. A bottoms product comprising $C_9$+ material is withdrawn as bottoms product from heavy naphtha splitter 46*a* through line 46*b*. The overhead product comprising $C_7$–$C_8$ aliphatics is charged through line 71 which is equipped with flow control valve 73, combined with $C_3$- olefinic gas flowing through line 104 and charged to the bottom of fluidized-bed reactor 74** as described above.

As mentioned above, the present invention enables the refiner to upgrade all or a part of the gasoline boiling range product from an FCC unit to maintain a desired average FCC gasoline octane number. The particular amount of FCC gasoline upgraded in the aromatization process of the present invention will be determined by economic factors in which the value of increasing the average octane number of the FCC gasoline pool is balanced against the concomitant yield loss.

CATALYSTS

The members of the class of zeolites useful in the gasoline upgrading process of the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present invention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length therein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Re. No. 29,948 (highly siliceous ZSM-5); U.S. Pat. Nos. 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Gallium-containing zeolite catalysts are particularly preferred for use in the present invention and are disclosed in U.S. Pat. Nos. 4,350,835 and 4,686,312, both of which are incorporated by reference as if set forth at length herein.

Zinc-containing zeolite catalysts are also preferred for use in the present invention, for example, U.S. Pat. Nos. 4,392,989 and 4,472,535, both of which are incorporated by reference as it set forth at length herein.

Catalysts such as ZSM-5 combined with a Group VIII metal described in U.S. Pat. No. 3,856,872, incorporated by reference as if set forth at length herein, are also useful in the present invention.

It is understood that aromatics and light paraffin production is promoted by those zeolite catalysts having a high concentration of Bronsted acid reaction sites. Accordingly, an important criterion is selecting and maintaining catalyst inventory to provide either fresh or regenerated catalyst having the desired properties. Typically, acid cracking activity (alpha value) can be maintained from high activity values greater than 200 to significantly lower values under steady state operation by controlling catalyst deactivation and regeneration rates to provide an apparent average alpha value below 200, preferably about 10 to 80.

EXAMPLE

The following example illustrates the production of an upgraded gasoline product from feedstock comprising heavy FCC naphtha and light olefins.

The feedstock is charged to a reaction zone containing ZSM-5 catalyst at 700° F. and 160 psig. WHSV based on $C_4$- light olefins is 0.75 $hr^{-1}$.

| | |
|---|---|
| FEEDSTOCK: | 25 wt % $C_2$= |
| | 25 wt % $C_3$= |
| | 50 wt % $C_7$+ FCC heavy gasoline |
| | (typically 180+ °F. boiling range) |
| | R.O.N. = 90.7 |
| | Sp. Gr. = 0.8193 |
| PRODUCT STREAM: | 7.2 wt % $C_1$-$C_3$ |
| | 9.8 wt % $C_4$ and $C_4$= |
| | 83.0 wt % $C_5$+ |
| | R.O.N. = 93.1 |
| | Sp. Gr. = 0.7790 |

Changes and modifications in the specifically described embodiments can be carried out without departing from the scope of the invention which is intended to be limited only by the scope of the appended claims.

What is claimed is:

1. An integrated catalytic cracking and gasoline upgrading process comprising the steps of:

(a) withdrawing a product stream from the riser reactor of a catalytic cracking process unit;

(b) charging said product stream to a primary fractionation zone;

(c) withdrawing an intermediate gasoline stream from said primary fractionation zone, said intermediate gasoline stream comprising olefinic gasoline having an ASTM D86 boiling range from about 90° to about 170° C.;

(d) contacting a first portion of said intermediate gasoline stream and a $C_2$-$C_5$ olefinic stream with a catalyst under conversion conditions to form an upgraded gasoline stream; and (e) charging a second portion of said intermediate gasoline stream together with said upgraded gasoline stream to a gasoline product storage facility.

2. The process of claim 1 wherein said catalyst comprises a zeolite.

3. The process of claim 2 wherein said zeolite comprises a zeolite having a Constraint Index of between about 1 and 12.

4. The process of claim 3 wherein said zeolite comprises a zeolite having the structure of at least one selected from the group consisting of ZSM-5, ZSM-11, ZSM-22, ZSM-23, ZSM-35, ZSM-48 and mixtures thereof.

5. The process of claim 3 wherein said zeolite has the structure of ZSM-5.

6. The process of claim 3 wherein said intermediate gasoline stream comprises a major portion of hydrocarbon compounds having from 4 to 11 carbon atoms.

7. The process of claim 3 wherein said intermediate gasoline stream comprises a major portion of hydrocarbon compounds having from 6 to 11 carbon atoms.

8. The process of claim 3 wherein said intermediate gasoline stream comprises a major portion of hydrocarbon compounds having from 9 to 11 carbon atoms.

9. The process of claim 6 wherein said conversion conditions comprise weight hourly space velocities based on $C_4$- light olefins of between 0.5 $hr^{-1}$ and 1 $hr^{-1}$, pressures between about 446 kPa and1136 kPa (50 psig and 150 psig) and temperatures between 260° C. and 399° C. (500° F. and 750° F.).

10. The process of claim 7 wherein said conversion conditions comprise weight hours space velocities based on $C_4$- light olefins of between 0.5 $hr^{-1}$ and 1 $hr^{-1}$, pressures between about 446 kPa and 1136 kPa (50 psig and 150 psig) and temperatures between 260° C. and 399° C. (500° F. and 750° F.).

11. The process of claim 8 wherein said conversion conditions comprise weight hourly space velocities based on $C_4$- light olefins of between 0.5 $hr^{-1}$ and 1 $hr^{-1}$, pressures between about 446 kPa and 1136 kPa (50 psig and 150 psig) and temperatures between 260° C. and 399° C. (500° F. and 750° F.).

* * * * *